US006139598A

United States Patent [19]

Narasimhan et al.

[11] Patent Number: 6,139,598

[45] Date of Patent: Oct. 31, 2000

[54] POWDERED METAL VALVE SEAT INSERT

[75] Inventors: Sundaram L. Narasimhan, Marshall, Mich.; Heron Rodrigues, Charlotte, N.C.; Yushu Wang, Marshall, Mich.

[73] Assignee: Eaton Corporation, Cleveland, Ohio

[21] Appl. No.: 09/196,007

[22] Filed: Nov. 19, 1998

[51] Int. Cl.[7] ..... C22C 33/00

[52] U.S. Cl. ..... 75/246; 75/231; 75/236; 75/243; 75/244

[58] Field of Search ..... 75/231, 236, 243, 75/244, 246

[56] References Cited

U.S. PATENT DOCUMENTS

| | | | |
|---|---|---|---|
| 3,856,478 | 12/1974 | Iwata et al. . | |
| 4,348,232 | 9/1982 | Hiraoka et al. | 75/238 |
| 4,363,662 | 12/1982 | Takahashi et al. | 75/243 |
| 4,546,737 | 10/1985 | Kazuoka et al. | 123/188 |
| 4,648,903 | 3/1987 | Ikenoue et al. | 75/230 |
| 4,671,491 | 6/1987 | Kuroishi et al. | 251/368 |
| 4,724,000 | 2/1988 | Larson et al. | 75/236 |
| 4,734,968 | 4/1988 | Kuroishi et al. | 29/156.7 A |
| 4,836,848 | 6/1989 | Mayama et al. | 75/231 |
| 4,970,049 | 11/1990 | Baker et al. | 419/11 |
| 5,000,910 | 3/1991 | Tokizane et al. | 419/29 |
| 5,009,842 | 4/1991 | Hendrickson et al. | 419/28 |
| 5,032,353 | 7/1991 | Smarsly et al. | 419/12 |
| 5,041,158 | 8/1991 | Larson | 75/231 |
| 5,051,232 | 9/1991 | Summers | 419/27 |
| 5,064,610 | 11/1991 | Sato et al. | 420/57 |
| 5,154,881 | 10/1992 | Rutz et al. | 419/37 |
| 5,217,683 | 6/1993 | Causton | 419/38 |
| 5,221,321 | 6/1993 | Lim | 75/246 |
| 5,271,683 | 12/1993 | Smetting et al. | 401/195 |
| 5,286,311 | 2/1994 | Schuler et al. | 148/328 |
| 5,312,475 | 5/1994 | Purnell et al. | 75/231 |
| 5,326,526 | 7/1994 | Ikenoue et al. | 419/38 |
| 5,413,073 | 5/1995 | Larson et al. | 123/188.3 |
| 5,674,449 | 10/1997 | Liang et al. | 420/12 |
| 5,824,922 | 10/1998 | Aonuma et al. | 75/236 |
| 5,926,686 | 7/1999 | Engstrom et al. | 419/37 |

OTHER PUBLICATIONS

Wear, The effect of operating conditions on heavy duty engine valve seat wear, Y. S. Wang, S. Narasimhan, J.M. Larson, J.E. Larson, G.C. Barber.

Sintered Valve Seat Inserts and Valve Guides: Factors Affecting Design, Performance & Machinability by H. Rodrigues.

Valve Gear Wear and Materials by S.L. Narahimhan and J.M. Larson.

*Primary Examiner*—Ngoclan Mai
*Attorney, Agent, or Firm*—Daniel S. Kalka

[57] ABSTRACT

A powdered metal blend mixture for making a powdered metal part especially a valve seat insert. The mixture includes 15 to 30 wt. % of a valve steel powder, 0 to 10 wt. % nickel, 0 to 5 wt. % copper, 5 to 15 wt. % of a ferro-alloy powder, 0 to 15 wt. % of a tool steel powder, 0.5 to 5 wt. % of a solid lubricant, 0.5 to 2 wt. % graphite, 0.3 to 1.0% of a temporary lubricant, and the balance being substantially a low alloy steel powder containing 0.6 to 2.0 wt. % molybdenum, 0 to 5 wt. % nickel, and 0 to 3.0 wt. % copper. The present invention provides improved high temperature wear and corrosion resistance over prior art materials as well as improved machinability. The blend of the present invention provides a relatively high density material that allows for a single press and sinter technique.

8 Claims, 5 Drawing Sheets

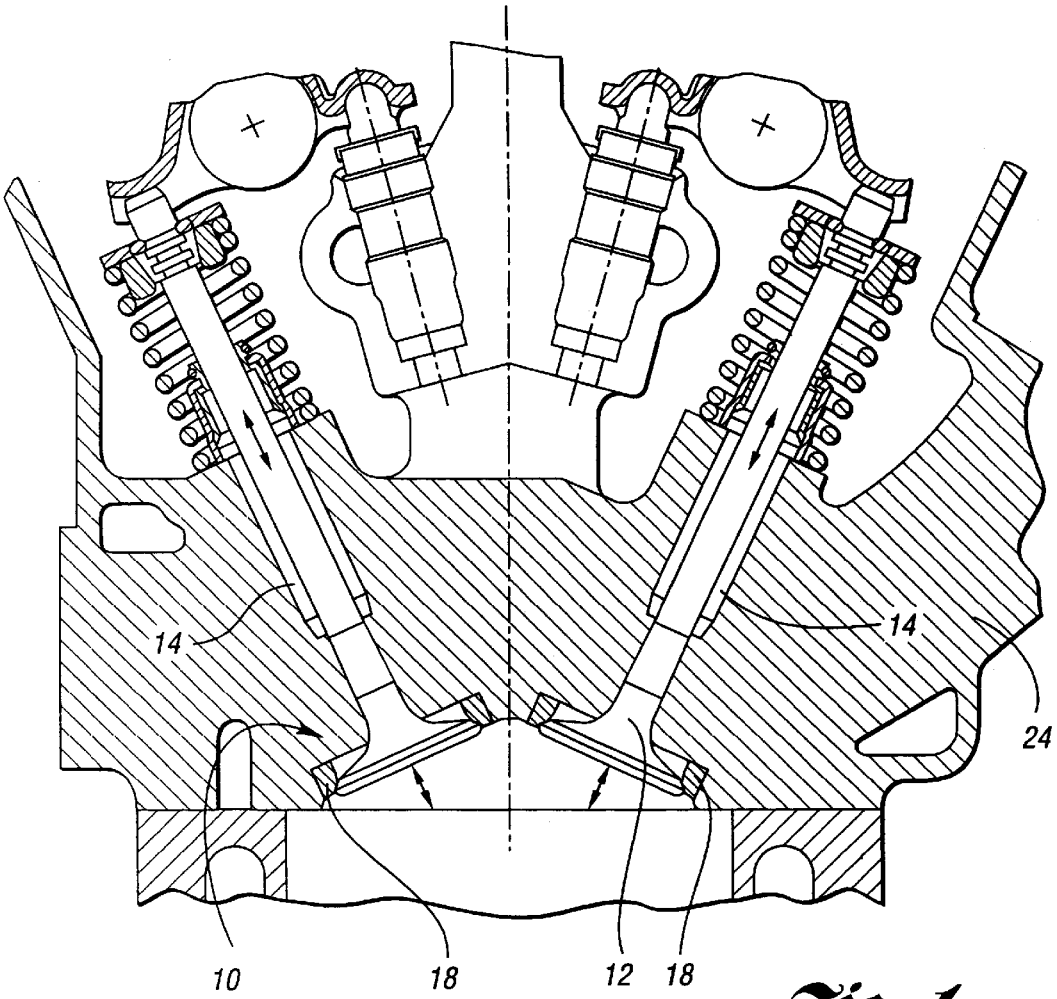
Fig. 1
Fig. 2
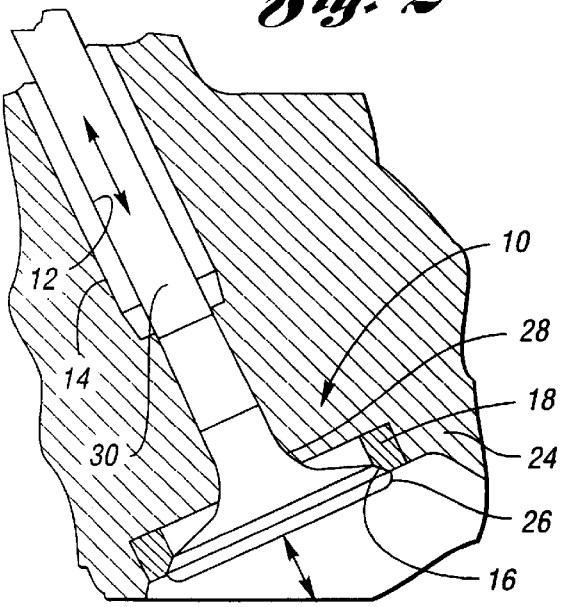
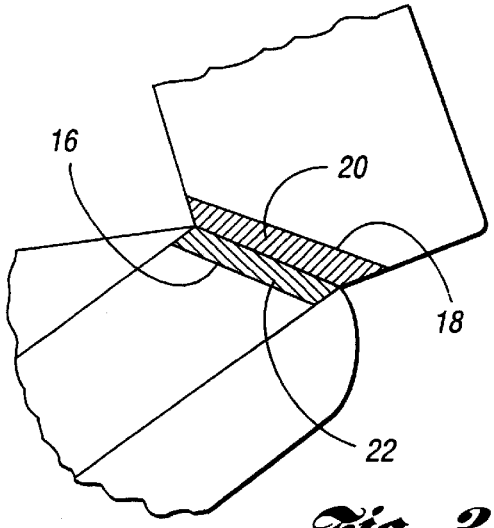
Fig. 3

POWDERED METAL VALVE SEAT INSERT

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

1. Field of the Invention

The present invention relates in general to metallic powdered blends, and more particularly to a new and improved metallic powdered blend useful for making a vehicle part such as a valve seat insert.

2. Description of the Related Art

The operation cycle of an internal combustion engine is well known in this art. The physical requirements for the intake and exhaust valves, valve guides, and valve seat inserts to effectively interact in sealing the combustion have been studied extensively.

Wear resistance is a prime requirement for valve seat inserts used in internal combustion engines. In an effort to achieve a combination of good heat and corrosion resistance and machinability coupled with wear resistance, exhaust valve seat inserts have been made from cobalt, nickel, or martensite iron based alloy castings. These alloys have been generally preferred over austenitic heat-resistant steels with high chromium and nickel content because of the presence of wear resistant carbides in the cast alloys.

Powder metallurgy has been employed in the manufacture of valve seat inserts as well as other engine components, because the net end shape is fairly readily achieved. Powder metallurgy permits latitude in selecting a variety of metallic or even ceramic compositions as well as offering design flexibility.

U.S. Pat. No. 4,724,000 assigned to the Assignee of the present invention and hereby incorporated by reference describes a wear resistant article manufactured using powder metallurgy. This patent is particularly directed to a valve seat insert.

U.S. Pat. No. 5,041,158 also relates to powdered metal parts and particularly the beneficial affects of the addition of a powdered hydrated magnesium silicate. This patent is also assigned to the Assignee of the present invention and hereby incorporated by reference.

Other patents of interest include: U.S. Pat. Nos. 4,546,737; 4,671,491; 4,734,968; 5,000,910; 5,032,353; 5,051,232; 5,064,610; 5,154,881; 5,271,683; and 5,286,311.

Valve seat inserts for internal combustion engines require high wear resistance materials which can offer high wear resistance even at elevated temperatures for prolonged periods of time. Valve seat inserts further require along with the high heat resistance, high creep strength and high thermal fatigue strength even under repeated impact loading at elevated temperatures.

Typically, the valve seat insert materials that are made from high alloy powders have low compressibility. Therefore, processes such as double pressing, double sintering, high temperature sintering, copper infiltrating, and hot forging are used to achieve a desired density level. Unfortunately, this can make the material prohibitively expensive.

Thus, there still exists a need for a powdered metal blend which will result in a relatively high density, and yet only utilize a single press and/or a single sintering method. Such a material blend will be capable of being compacted to a minimum density ranging from about 6.7 g/cm$^3$ to about 7.1 g/cm$^3$ to make a component that can function in a severe engine environment. Such a powder metal blend will be fairly cost effective yet still offer significant wear resistance, high temperature resistance, machinability, high creep strength, and high thermal fatigue strength.

BRIEF SUMMARY OF THE INVENTION

The present invention is directed to solving the aforementioned problems as well as others by providing a novel powdered metal blend mixture that uses a unique combination of a valve steel powder for high temperature wear and corrosion resistance with a ferro-alloy powder such as ferro-molybdenum, ferro-vanadium and ferro-niobium powder for high temperature hot hardness (the term "hot hardness" means hardness measured at elevated temperatures) and with copper for machinability and thermal conductivity. The blend according to the present invention includes a tool steel powder for wear resistance and a solid lubricant to provide low friction and sliding wear as well as an improvement in machinability.

Accordingly, one object of the present invention is directed to a new powder metal material blend that results in a relatively high density while only requiring a single press and/or single sintering method.

Another object of the present invention is directed to a powdered metal blend which contains a mixture of valve steel powder, nickel, copper, ferro-alloy powder, a tool steel powder, a solid lubricant, graphite and a temporary or fugitive lubricant, with the balance being substantially a low alloy steel powder containing a selected amount of molybdenum.

A further object of the present invention is directed to providing a powdered metal engine component normally used in wear resistance applications that provides superior properties in hardness, hot hardness, abrasive wear, adhesive wear, scuffing, high temperature oxidation tendency, and thermal creep resistance.

Still another object of the present invention is to provide a powdered metal blend for making an engine component such as a valve seat insert.

The present invention comprises an improved powdered metal engine component having a chemical composition of between about 0.8 to about 2.0% carbon (C), from about 2.0 to about 6.0% chromium (Cr), from about 1.0 to about 20.0% copper (Cu), from about 0.5 to about 2.0% manganese (Mn), from about 5.0 to about 8.0% molybdenum (Mo), from about 4.0 to about 7.0% nickel (Ni), from about 0.05 to about 0.15% nitrogen (N), from about 0.2 to about 0.7% tungsten (W), from about 0.05 to about 0.5% vanadium (V), from about 0.2 to about 0.6% sulphur (S), and the balance being substantially iron (Fe).

The various features of novelty which characterize the invention are pointed out with particularity in the claims annexed to and forming a part of this disclosure. For a better understanding of the invention, its operating advantages, and specific objects attained by its uses, reference is made to the accompanying Examples and descriptive matter in which a preferred embodiment of the invention is illustrated.

BRIEF DESCRIPTION OF THE DRAWINGS

FIG. 1 is a cross-sectional view illustrating a valve assembly and its associated environment;

FIG. 2 is a cross-sectional view illustrating a valve assembly in more detail;

FIG. 3 is a cross-sectional view of even a more detailed view of the valve seat insert and valve set face in a sealing relationship;

DETAILED DESCRIPTION OF THE INVENTION

Figure 4:
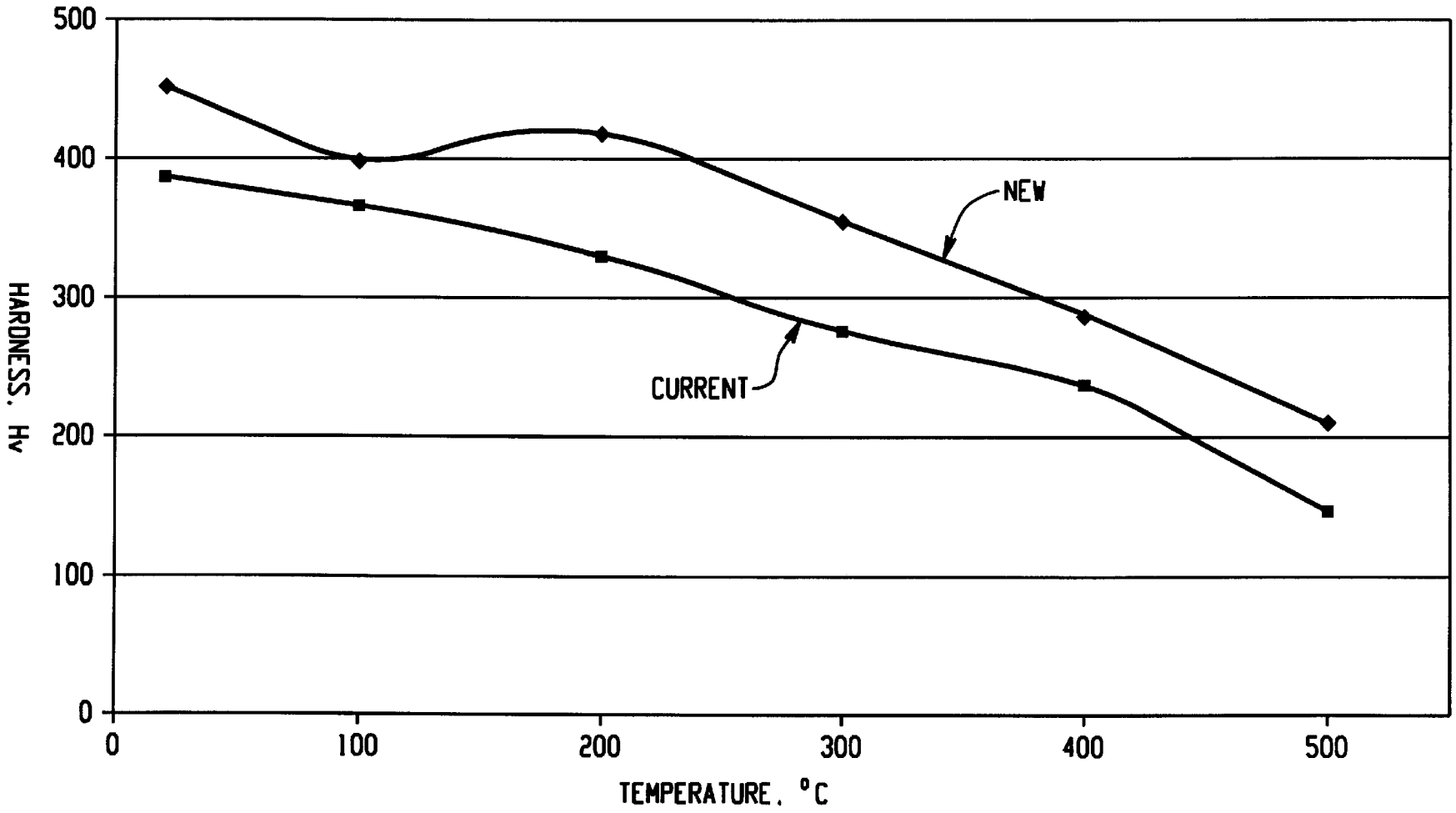
FIG. 4 is a graph showing a hot hardness comparison of the present invention with a current material.

It is desirable to construct vehicles with engine durability that can achieve 150,000 miles or more. In designing engine components for such vehicles, the components require a material that offers significant wear resistance, high temperature resistance and machinability.

In the specification, unless otherwise specified, all temperatures are in degrees Celsius (° C.), and all percentages (%) are on a weight percent basis.

The present invention provides a powdered metal part especially suited for an engine component like a valve seat insert. The powdered metal blend of the present invention is suited in particular for valve seat inserts for nitrided engine valves. It should be immediately apparent that the powdered metal part in accordance with the present invention is equally suitable to other applications as well. An engine valve train component such as a valve seat insert constructed with the powdered metal blend according to the present invention may be employed as an intake valve seat insert as well as an exhaust valve seat insert component.

Referring to FIGS. 1–3, there is illustrated a valve assembly generally designated 10 for use in an engine. Valve assembly 10 includes a plurality of valves 12 each reciprocatingly received within the internal bore of a valve stem guide 14. The valve stem guide 14 is a tubular structure which is inserted into the cylinder head 24. These engine components are devices well known to those in this art. The present invention is not intended to be limited to any specific structure since modifications and alternative structures are provided by various manufacturers. These valve assembly drawings are being provided for illustrative purposes to facilitate a better understanding of the present invention.

Valve 12 includes a valve seat face 16 interposed between the cap 26 and fillet 28 of the valve 12. Valve stem 30 is located normally upwardly of neck 28 and usually is received within valve stem guide 14. A valve seat insert 18 is normally mounted within the cylinder head 24 of the engine. Preferably, the insert 18 is annular in shape with a cross-section shown, and cooperatively receives the valve seat face 16.

In order for a powdered metal part to work in a severe environment, such as a severe engine environment, the powdered metal part blend should be capable of being compacted to a minimum density of 6.7 grams per cubic centimeter ($g/cm^3$) to 7.1 $g/cm^3$. Preferably, the blend is compacted to a minimum density of 6.9 $g/cm^3$.

The powdered metal blend mixture of the present invention comprises a valve steel powder, nickel, copper, a ferro-alloy powder, a tool steel powder, a solid lubricant, graphite, and a powdered temporary or fugitive lubricant, with the balance being a low alloy steel powder. This mixture in accordance with the present invention contains the following amounts of the above components. There is 15 to 30% valve steel powder, from 0 to 10% nickel, from 0 to 5% copper, 5 to 15% ferro-alloy powder, from 0 to 15% tool steel powder, 0.5 to 5% solid lubricant, 0.5 to 2.0% graphite, 0.3 to 1.0% powdered fugitive lubricant and the balance being a low alloy steel powder containing 0.6 to 2.0% molybdenum. Preferably, the low alloy steel powder contains 0.6 to 2.0% molybdenum, from 0 to 5% nickel, and from 0 to 3% copper.

The powdered metal blend mixture of the present invention uses the combination of the valve steel powder for high temperature wear and corrosion resistance with the ferro-alloy powder for high temperature hot hardness. The tool steel powder is added for wear resistance and hot hardness. The solid lubricants provide a low friction for reducing sliding wear as well as improving machinability. Alloying elements like molybdenum and chromium provide solid solution strengthening for wear and corrosion resistance. The nickel and the austenitic valve steel powder stabilizes the face centered cubic (FCC) matrix and achieves heat resistance. The iron-molybdenum hard particles provide wear and hot hardness. The graphite and a solid lubricant such as a powdered hydrated magnesium silicate (talc), molybdenum disulfide ($MoS_2$), or calcium fluoride ($CaF_2$) allows for better wear resistance and machinability. The powdered fugitive or temporary lubricant such as ACRA-WAX C provides for a longer die life by preventing galling of tools during compaction.

While the powder can be a mixture of alloy constituents for producing the desired alloying chemistry, the powders are preferably pre-alloyed powders.

The first component of the blend in accordance with the present invention is a valve steel powder and is about 15 to about 30 weight percent of the mixture. Preferably, the valve steel powder constitutes about 20% of the blend or mixture. A suitable valve steel powder includes but is not limited to 21-2, 23-8N, or 21-4N which are commercially available from OMG Americas. These are iron based powders and the 21-2N basically means 21% chromium and 2% nickel. The 21-4N means 21% Cr and 4%Ni. Similarly, 23-8N designation basically means 23% chromium and 8% nickel. The chemical composition of a typical 21-2N metal powder falls within the following ranges:

| | |
|---|---|
| C | 0.50–0.60% |
| Mn | 7.0–9.5% |
| Si | 0.08–0.25% |
| Cr | 19.3–21.5% |
| Ni | 1.5–2.75% |
| N | 0.20–0.40% |
| Fe | balance |

The chemical composition of a typical 23-8N metal powder falls within the following ranges:

| | |
|---|---|
| C | 0.50–0.60% |
| Mn | 1.50–3.50% |
| Si | 0.60–0.90% |
| Cr | 22.0–24.0% |
| Ni | 7.0–9.0% |
| N | 0.28–0.35% |
| Fe | balance |

The chemical composition of a typical 21-4N metal powder falls within the following ranges:

| | |
|---|---|
| C | 0.48–0.54% |
| Mn | 8.00–9.50% |
| Si | 0.08–0.25% |
| Cr | 20.0–22.0% |
| Ni | 3.25–4.50% |
| N | 0.38–0.50% |
| Fe | balance |

The second component of the mixture according to the present invention is nickel. The nickel is added to the mixture on a weight percent basis from about 0 to about 10% of the mixture, and preferably is about 7.0%. The nickel powder is meant to include any nickel containing powder including but not limited to particles of substantially pure nickel, a masteralloy, or particles of nickel in admixture with alloying elements. The composition of the nickel should fall within the given percentage range.

Copper powder is the third component of the mixture. It is added from about 0 to about 5% on a weight percent basis of the mixture, and preferably is about 2.0% of the mixture. Similarly, the copper powder is meant to include but is not limited to any copper containing powder such as particles of substantially pure copper, particles of copper in an admixture with alloying elements, and/or other fortifying elements, and/or particles of pre-alloy copper. A substantial amount (up to about 20%) of copper can be added through a copper infiltration process for the purpose of increasing density, thermal conductivity and machinability.

The fourth component of the mixture is a ferro-alloy powder which preferably contains ferro-molybdenum. The ferro-alloy powder constitutes about 5 to about 15% of the mixture and preferably is about 9% of the mixture. Molybdenum-containing iron-based powder for use with the present invention is commercially available from ShieldAlloy. It is a pre-alloy of iron with about 60 weight percent dissolved molybdenum and containing less than about 2.0 weight percent of other pre-alloyed elements. This iron based powder may contain elements in addition to the molybdenum that are pre-alloyed with the iron, but it is generally a benefit to the practice of the invention, if this component of the invention is substantially free of elements pre-alloyed with the iron other than molybdenum.

The fifth component of the mixture is a tool steel powder which constitutes from about 0 to about 15% of the mixture. Preferably, this component is also a pre-alloyed powder which is a ferro-alloy of iron, carbon, and at least one transition element. It is also preferred that iron making up this component as in the other components be substantially free of impurities or inclusions other than metallurgy carbon or the transition element. A suitable tool steel powder includes but is not limited to M series tool steel powders commercially available from Powdrex.

The sixth component of the mixture in accordance with the present invention is a solid lubricant such as a powdered hydrated magnesium silicate (commonly referred to as talc), $MoS_2$ or $CaF_2$. Of course, any conventional solid lubricant may be used with the mixture of the present invention including, but not limited to any other disulfide or fluoride type solid lubricant.

The seventh component of the mixture in accordance with the present invention is graphite which constitutes about 0.5 to about 2.0% of the mixture. Graphite is a preferred way to add carbon to the mixture for compacting. One suitable source for graphite powder is Southwestern 1651 grade, which is a product of Southwestern Industries Incorporated.

The eighth component of the mixture according to the present invention includes a powdered lubricant which represents from about 0.3 to about 1.0% of the mixture. The powdered lubricant is referred to herein as a temporary or fugitive lubricant since it bums off or pyrolyzes during the sintering step. A suitable lubricant would include a conventional waxy or fatty material such as zinc stearates, waxes, commercially available but proprietary ethylene stearamide compositions which volatilize upon sintering. One such suitable powdered lubricant includes ACRAWAX C which is available from Glyco Chemical Co.

The balance of the mixture is a low alloy steel powder that preferably contains about 0.6 to about 2.0% molybdenum, from about 0 to about 5% nickel, and from 0 to about 3% copper. A suitable low alloy steel powder blend is 85HP or 150HP available from Hoeganaes Corporation.

The powdered metal blend is thoroughly mixed for a sufficient time to achieve a homogeneous mixture. Normally, the mixture is blended for about 30 minutes to about two hours and preferably about 1 hour to result in a homogeneous mixture. Any suitable mixing means such as a ball mixer may be employed.

The mixture is then compacted at compacting pressures preferably ranging from about 50 tons per square inch (TSI) to about 65 tons per square inch with a preferred pressure of about 60 TSI. The compacting pressure is adequate to press and form green compacts to a near net shape or even a net shape having a desired green density ranging from about 6.7 $g/cm^3$ to about 7.1 $g/cm^3$ with a preferred density of about 6.9 $g/cm^3$. Compaction is done generally with a die of a desired shape. In the case of iron-based metal powders for making insert parts, the lubricated blend of powder is pressed to at least about 20 tons per square inch, generally higher, for example, about 40 to about 60 tons per square inch. Ordinarily, any pressure lower than about 35 tons per square inch is hardly used. Pressures above about 65 tons per square inch, while useful, may be prohibitively expensive. The compaction can be performed either uniaxial or isostatic.

The green compact is handled and usually conveyed to a sintering furnace, where sintering of the compact takes place. Sintering is a bonding of adjacent surfaces in the compact by heating the compact below the liquidus temperature of the majority of the ingredients in the compact.

The sintering conditions in the present invention use conventional sintering temperatures, e.g., about 1040° C. to 1150° C. (preferably at about 1100° C.). A higher sintering temperature (about 1250° C. to about 1350° C., preferably about 1300° C.) may alternately be used for about 20 minutes to about one hour, and preferably about 30 minutes in a reducing atmosphere of a gaseous mixture of nitrogen ($N_2$) and hydrogen ($H_2$). Sintering is performed at a temperature higher than about 1100° C. for a time period sufficient to effect diffusion bonding of the powder particles at their point of contact and form an integrally sintered mass. Sintering is preferably done in a reducing atmosphere such as $N_2/H_2$ or a dry associated ammonia having a dew point in the order of about −40° C. Sintering may also be done with an inert gas like argon, or in a vacuum.

Advantageously, the resultant product may be used in both the as-sintered condition and/or a heat-treated condition. Suitable heat treating conditions include but are not limited to further nitriding, carburizing, carbonitriding, or steam treatment the compacted powdered metal component. Alternatively, the resultant product may be copper infiltrated to improve thermal conductivity.

Photomicrographs reveal that the microstructure consists of about 20 to about 30%, preferably about 25 percent phase containing fine carbide in an austenitic matrix, about 5 to about 10%, preferably about 7 percent hard phase rich in molybdenum, about 1 to about 5%, preferably about 2 percent solid lubricant, and the balance being a tempered martensite.

The chemical composition of the finished product is as follows with all percentages being calculated on a weight percent basis:

| | |
|---|---|
| C | about 0.8 to about 2.00% |
| Cr | about 2.0% to about 6.0% |
| Cu | about 1.0% to about 20.0% |
| S | about 0.2 to about 0.6% |
| Mn | about 0.5 to about 2.0% |
| Mo | about 5.0 to about 8.0% |
| Ni | about 4.0 to about 7.0% |
| N | about 0.05 to about 0.15% |
| W | about 0.2 to about 0.7% |
| V | about 0.05 to about 0.5% |
| Fe | balance (substantially) |

In the preferred embodiment, the chemical composition of the finished product is as follows on a weight percent basis (wt. %):

| | |
|---|---|
| C | about 1.50% |
| Cr | about 4.10% |
| Cu | about 2.0% |
| Mn | about 1.0% |
| Mo | about 6.5% |
| Ni | about 5.5% |
| N | about 0.1% |
| S | about 0.5% |
| W | about 0.4% |
| V | about 0.15% |
| Fe | substantially balance |

Also in the preferred embodiment, the chemical composition of the finished product with copper infiltration is as follows on a weight percent basis (wt %):

| | |
|---|---|
| C | about 1.2% |
| Cr | about 3.96% |
| Cu | about 12.52% |
| Mn | about 1.34% |
| Mo | about 8.03% |
| Ni | about 5.90% |
| N | about 0.10% |
| S | about 0.29% |
| W | about 0.23% |
| V | about 0.10% |
| Fe | substantially balance |

In FIG. 4, there is shown a hot hardness comparison of an insert material made with the present invention identified as "new" with that of a currently employed material identified as "current". The current material is presently being used in engines and is a commercially accepted product that has a chemical content as follows: 1.05–1.25%C; 1.0–2.7% Mn; 4.0–6.5% Cr; 2.5–4.0% Cu; and 1.6–2.4% Ni. Hardness Hv stands for a standard Vickers hardness test. A description of the testing procedures appears in Y. S. Wang, et al., "The Effect of Operating Conditions on Heavy Duty Engine Valve Seat Wear," WEAR 201 (1996).

Figure 5:
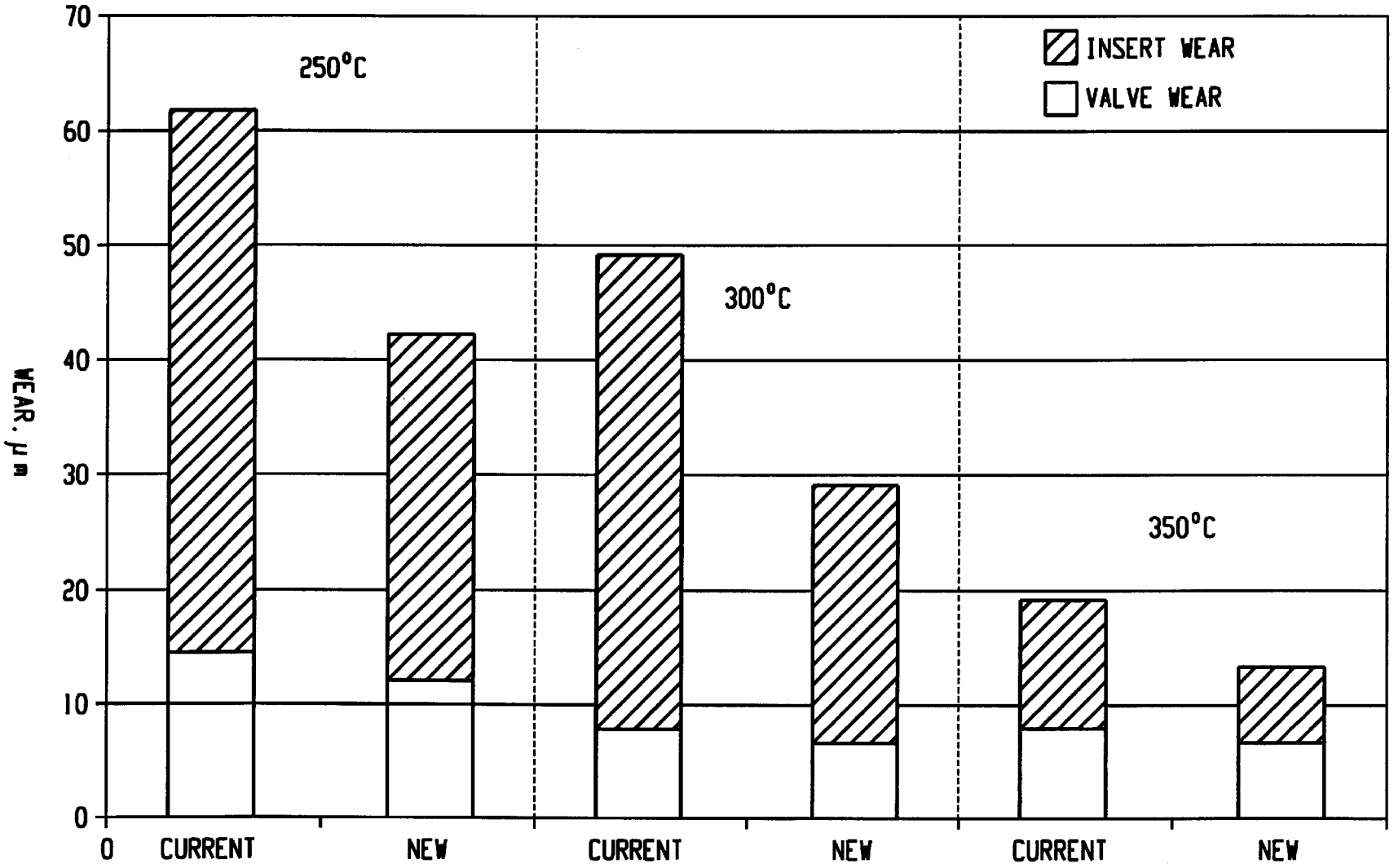
FIG. 5 is a graph showing seat wear rig comparison test data for the present invention with a current material.
Figure 6:
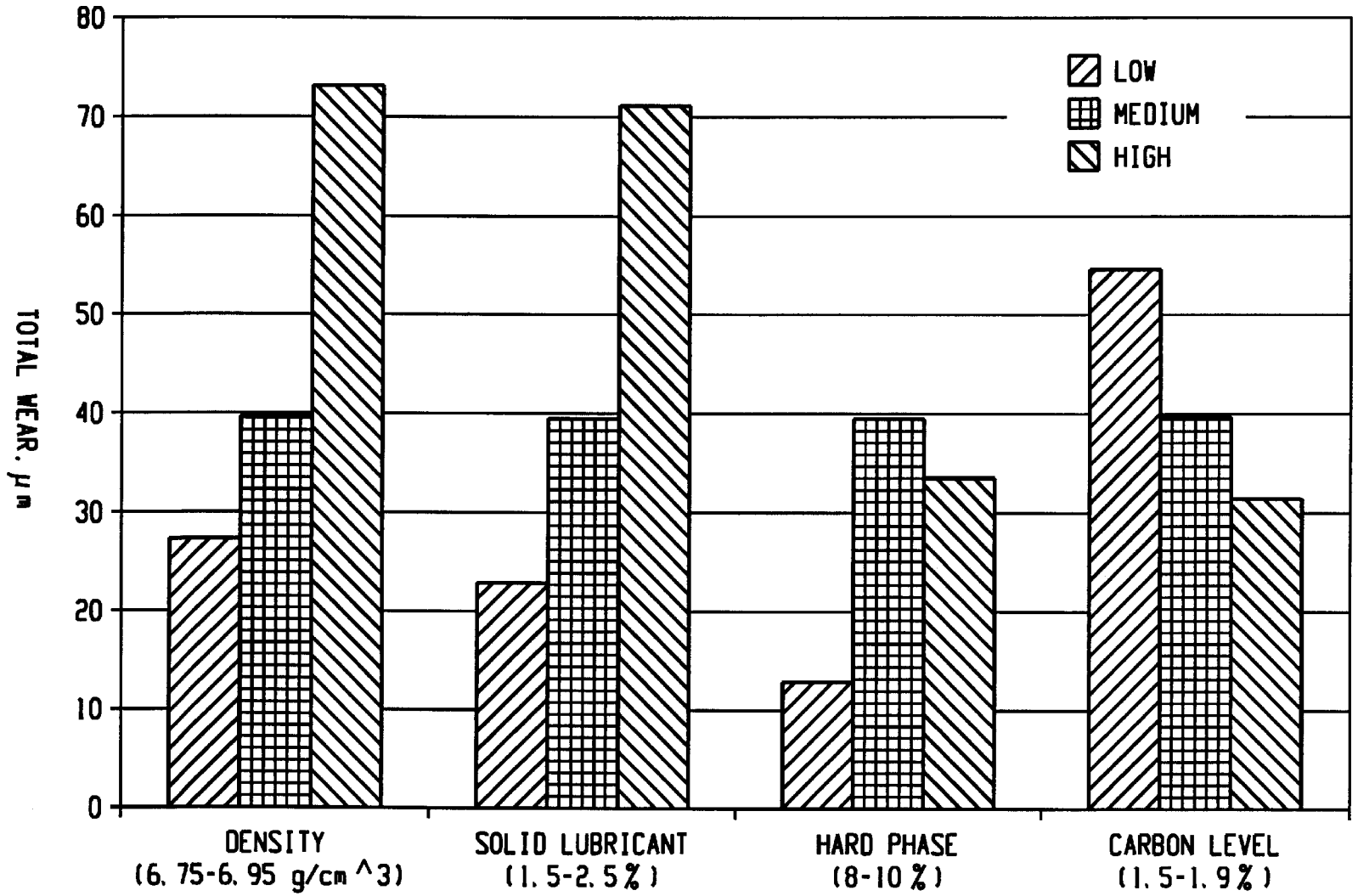
FIG. 6 is a graph showing seat wear limit test data for the present invention with a current material.

FIG. 5 is an illustration of seat wear rig comparison test results and FIG. 6 shows seat wear rig limit test data. Seat wear rig limit is the material specification limit passed by rig testing. A description of rig wear test procedures appears in Y. S. Wang, et al., "The Effect of Operating Conditions on Heavy Duty Engine Valve Seat Wear", WEAR 201 (1996). In FIG. 6, the solid lubricant is $MoS_2$. The hard phase represents Fe—Mo particles.

Figure 7:
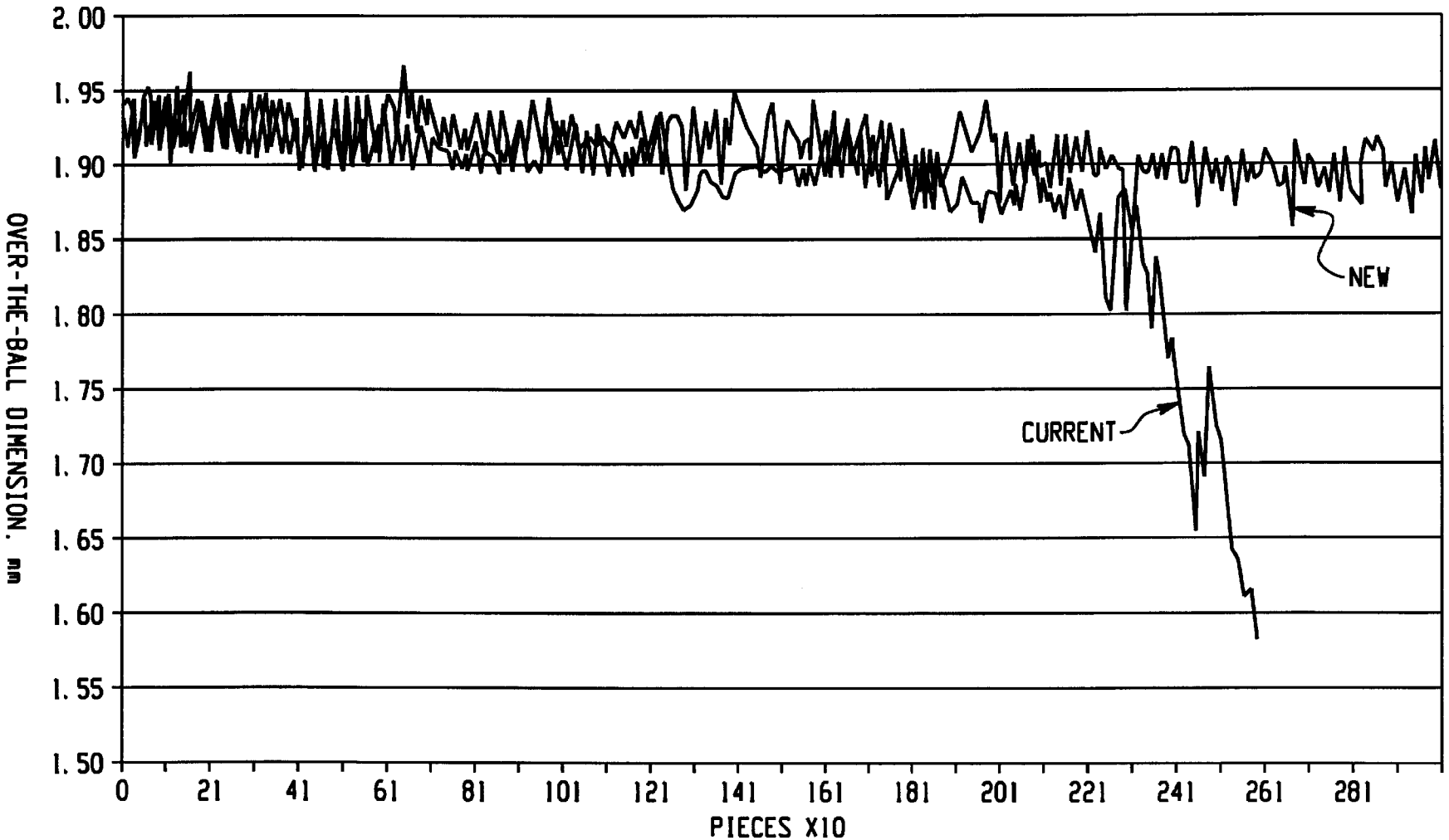
FIG. 7 is a graph showing machinability comparison data for the present invention with a current material.

FIG. 7 is a machinability comparison graph between the present invention and the prior art. A description of the machinability testing procedure is given in H. Rodrigues, "Sintered Valve Seat Inserts and Valve Guides: Factors Affecting Design, Performance, and Machinability, "Proceedings of the International Symposium on Valvetrain System and Design Materials, (1997).

A careful review of these figures shows the improvement in desired characteristics achieved with the present invention. The present invention provides increased wear resistance even at elevated temperatures for prolonged periods of time.

The following examples illustrate the present invention, but are not intended to limit it thereto:

EXAMPLE I

The powder is blended using the following formulation in a double cone blender for 30 minutes. The blend consists of 20% valve steel powder (such as 23-8N or 21-4N or 21-2N available from OMG Americas), 5% nickel available from Inco, 2% copper available from OMG Americas, 10% ferro-alloy powder (such as Fe—Mo powder from ShieldAlloy), 10% tool steel powder (such as M series tool steel powder from Powdrex), 3% solid lubricant (such as molybdenum disulfide from Hohman Plating, 1%o graphite from Southwestern Graphite, 1% solid lubricant (such as powdered hydrated magnesium silicate or talc from Millwhite), 1% fugitive powdered lubricant Acrawax C from Baychem, and the balance being a low alloy steel powder from Hoeganaes which contains 0.85–1.5% molybdenum.

Weight percentage in kilograms (kg) for the blend:

200 kg—21-2N
50 kg—Ni
20 kg—Cu
10 kg—M2 tool steel powder
30 kg—MoS2
100 kg—Fe—Mo
5 kg—Acrawax C
10 kg—Talc
580 kg—Low alloy Mo steel The blend is then compacted to a density of 6.8–7.0 g/cm^3. Sintering is conducted in a reduced atmosphere of 90% nitrogen with balance hydrogen at 2100° F. for 20–30 minutes. Sintering is followed by carburizing at 1600° F. for 2 hours at 1.0 carbon potential, then quench in oil. Carburizing is followed by tempering at 800° F. for one hour in nitrogen atmosphere.

EXAMPLE II

The powder is blended using the following formulation in a double cone blender for 30 minutes. The blend consists of 20% valve steel powder (such as 23-8N or 21-4N or 21-2N available from OMG Americas), 5% nickel from Inco, 2% copper from OMG Americas, 10% ferro-alloy powder (such as Fe—Mo powder from ShiedAlloy), 10% tool steel powder (such as M series tool steel powder from Powdrex), 3% solid lubricant (such as molybdenum disulfide from Hohman Plating, 1% graphite from Southwestern Graphite, 1% solid lubricant powdered hydrated magnesium silicate or talc from Millwhite and the balance being a low alloy steel powder available from Hoeganaes which contains 1.5% molybdenum.

Weight percentage in kilograms (kg) for the blend:

200 kg—21-2N
50 kg—Ni
20 kg—Cu
10 kg—M2 tool steel powder
30 kg—MoS2
100 kg—Fe—Mo
5 kg—Acrawax C
10 kg—Talc
580 kg—Low alloy Mo steel The blend is then compacted to a density of 6.8–7.0 g/cm^3 and copper slug is made of Greenback 681 powder and compacted to a density of 7.1–7.3 g/cm^3. The infiltrate is placed on the part and the pair is sintered together in a reduced atmosphere of 90% nitrogen with balance hydrogen at 2100° F. for 20–30 minutes to achieve a density of 7.3 g/cm^3 minimum. Sintering is followed by carburizing at 1600° F. for 2 hours at 1.0 carbon potential and then quenched in oil. Carbuiizing is then followed by tempering at 800° F. for one hour in nitrogen atmosphere.

While specific embodiments of the invention have been shown and described in detail to illustrate the application of the principles of the invention, it will be understood that the invention may be embodied otherwise without departing from such principles.

We claim:

1. A powdered metal part having a chemical composition on a weight percent basis, comprising:

about 0.8% to about 2.0% of C;
about 2.0% to about 6.0% of Cr;
about 1.0% to about 20% of Cu;
about 0.5% to about 2.0% of Mn;
about 5.0% to about 8.0% of Mo;
about 4.0% to about 7.0% of Ni;
about 0.05% to about 0.15% of N;
about 0.2% to about 0.7% of W;
about 0.05% to about 0.5% of V;
about 0.2% to about 0.6% of S;
the balance substantially being Fe.

2. A powdered metal part as recited in claim 1, wherein said powdered metal part comprises a compacted powdered metal blend, said compacted powdered metal blend being compacted to a density ranging from about 6.7 g/cm$^3$ to about 7.1 g/cm$^3$.

3. A powdered metal part as recited in claim 2, wherein said powdered metal part further comprises a microstructure having about 20 wt. % to about 38 wt. % phase containing carbide in an austenitic and martensitic matrix, about 5 wt. % to 10 wt. % phase rich in molybdenum, about 1 wt. % to 5 wt. % of a solid lubricant and a balance being a tempered martensite.

4. A powdered metal part as recited in claim 1, wherein the chemical composition comprises:

| Element | Wt. % |
|---|---|
| C | 1.50 |
| Cr | 4.10 |
| Cu | 2.0 |
| Mn | 1.0 |
| Mo | 6.5 |
| Ni | 5.5 |
| N | 0.1 |
| S | 0.5 |
| W | 0.4 |
| V | 0.15 |
| Fe | balance. |

5. A powdered metal part as recited in claim 1, wherein said powdered metal part is a valve seat insert.

6. A powdered metal part as recited in claim 3, wherein said powdered metal part is valve seat insert for an internal combustion engine.

7. A powdered metal part as recited in claim 1, wherein the chemical composition comprises:

| Element | Wt. % |
|---|---|
| C | about 1.20 |
| Cr | about 3.96 |
| Cu | about 12.52 |
| Mn | about 1.34 |
| Mo | about 8.03 |
| Ni | about 5.90 |
| N | about 0.10 |
| S | about 0.29 |
| W | about 0.23 |
| V | about 0.10 |
| Fe | balance. |

8. A powdered metal part as recited in claim 7, wherein said powdered metal part is a valve seat insert for an internal combustion engine.

* * * * *